US005879748A

United States Patent [19]

Conti et al.

[11] Patent Number: 5,879,748

[45] Date of Patent: Mar. 9, 1999

[54] PROTECTIVE LUBRICANT EMULSION COMPOSITONS FOR PRINTING

[75] Inventors: Ronald S. Conti, Wilmington; John Schoell, Naperville; Donatas Ramanauskas, Villa Park, all of Ill.

[73] Assignee: Varn Products Company Inc., Oakland, N.J.

[21] Appl. No.: 840,676

[22] Filed: Apr. 29, 1997

[51] Int. Cl.[6] ..... B05D 3/02

[52] U.S. Cl. ..... 427/391; 427/411; 427/428; 508/110; 510/124; 510/421; 510/422

[58] Field of Search ..... 427/341, 402, 427/407.1, 428; 508/110; 510/124, 421, 422

[56] References Cited

U.S. PATENT DOCUMENTS

| | | | |
|---|---|---|---|
| 2,275,578 | 3/1942 | Wood . | |
| 2,458,981 | 1/1949 | Cotherman . | |
| 2,673,520 | 3/1954 | Bainbridge . | |
| 2,696,168 | 12/1954 | Costello . | |
| 2,713,307 | 7/1955 | Adams . | |
| 2,964,058 | 3/1960 | Pihl . | |
| 3,050,416 | 8/1962 | Yahnke et al. . | |
| 3,861,351 | 1/1975 | Bonwit et al. . | |
| 4,110,118 | 8/1978 | Salvant Dalmau et al. . | |
| 4,170,681 | 10/1979 | Edwards et al. . | |
| 4,808,443 | 2/1989 | Minamoto et al. . | |
| 4,869,921 | 9/1989 | Gabel et al. . | |
| 5,022,947 | 6/1991 | Hasegawa et al. . | |
| 5,035,946 | 7/1991 | Baker et al. . | |
| 5,165,967 | 11/1992 | Theno et al. . | |
| 5,340,495 | 8/1994 | Mulcahy et al. | 510/421 X |
| 5,460,856 | 10/1995 | O'Lenick . | |
| 5,518,640 | 5/1996 | Rodzcwich | 134/2 X |
| 5,535,676 | 7/1996 | Buschulte et al. . | |

FOREIGN PATENT DOCUMENTS

| | | |
|---|---|---|
| 0399377A1 | 11/1990 | European Pat. Off. . |
| 2124650A | 2/1984 | United Kingdom . |

*Primary Examiner*—Michael Lusignan
*Attorney, Agent, or Firm*—Fay, Sharpe, Beall, Fagan, Minnich & McKee

[57] ABSTRACT

A protective non-silicone oil aqueous lubricant emulsion for web off-set lithographic printing comprises from about 30 wt % to about 70 wt % hydrocarbon oil, from about 1 wt % to about 8 wt % of a surfactant having an HLB factor less than about 6, from about 2 wt % to about 9 wt % of a surfactant having an HLB factor greater than about 11, and from about 25 wt % to 60 wt % water, the emulsion having an average particle diameter of from about 500 nm to about 1100 nm. The emulsion enhances control of the dimensional stability of inked sheets and of the coefficient of friction of the heatset web.

25 Claims, No Drawings

PROTECTIVE LUBRICANT EMULSION COMPOSITONS FOR PRINTING

BACKGROUND OF THE INVENTION

The invention relates to protective lubricant emulsion compositions for web offset lithographic printing.

Web offset lithographic printing is a high speed, high volume process for printing on a continuous paper roll, referred to as a "web". Heat-set web printing is a variation of the offset lithographic printing process, and is employed in commercial printing of medium to high quality work. The inks used in heat-set web printing are specially formulated to provide high gloss and a high quality appearance on the printed sheet. Such inks require that a protective lubricant be applied after the oven curing and chilling stages. This protective lubricant aids in final sheeting and finishing. It prevents marring of the ink surface, and marking or streaking of the partially cured ink.

During heat-set web printing, the desired image is printed on the web with a viscous heat-set ink. The printed web then travels through an oven wherein it is heated to temperatures of 200° F. to 300° F. The oven temperature is typically 300° to 500° F. to achieve this web temperature. Typically, any point on the web traverses the oven in less than a second. The application of heat evaporates ink solvents and is the first step of the multi-step ink drying process. The application of heat to the paper web also has the undesirable effect of removing necessary moisture from the paper.

Upon exiting the oven, the heated web travels over a series of large diameter, water cooled rollers that are incrementally chilled to gradually lower the temperature of the web to about 75° F. This chilling process sets, or dries, the ink surface. At this point the ink is about 80% to 90% set or dried. The web then travels over an applicator device that applies a dilute aqueous lubricant emulsion, commonly a polydimethylsiloxane (silicone) emulsion, over the entire web surface. An example of such an applicator device is the "Automatic Silicone Applicator" made by Ryco Graphic Manufacturing, Inc. This aqueous lubricant emulsion serves to restore moisture to the paper web and to lubricate the ink surface on the printed web. The printed web then travels over surfaces which it directly contacts, such as angle bars, turn bars and the surface of a metal nose cone whereby the printed web is folded. Without the application of a protective aqueous lubricant after the heating and chilling stages, the ink would mar or streak on the printed web as it travels over these surfaces. The aqueous lubricant emulsion also prevents ink build-up on surfaces which could further damage the appearance of the printed web. Moisture is also applied to the web via this aqueous lubricant emulsion, which serves to replace moisture the paper loses during heating in the oven.

Restoration of moisture prior to finishing, bindery and trimming is important because dried paper is dimensionally unstable and brittle. Dried paper is also hygroscopic and will absorb moisture from the surrounding air. Dimensions of paper sheets change as moisture is absorbed. Such changes in paper dimension can ruin a final printed article when they take place after bindery and trimming of printed sheets. The result is a printed article with uneven and/or wavy edges. This is due to differential expansion of paper sheets, commonly referred to as "signatures", after the confinement of being bound together, and subsequent reabsorption of moisture in the form of ambient humidity. Restoration of moisture by the current process and with the material or emulsion described in detail below precludes these problems. Moisture restoration also improves ductility of paper. This helps reduce cracking of paper when it is folded in finishing or bindery.

Silicone lubricant emulsions are commonly used to lubricate and remoisten the paper web. Silicone lubricant emulsions are supplied to the printer with approximately 20 to 60% (wt) polydimethylsiloxane (silicone oil) content. The remaining portion is water, emulsifiers, and optional antistatic agents. The viscosities of silicone oils used in preparation of such emulsions are typically 300 to 500 centistokes. These silicone oil emulsions are diluted with water by the printer prior to use. Typical dilutions range from 1% to 10% of the 60% silicone oil emulsion with 99% to 90% water. The lower wt % silicone emulsions are used in proportionally greater quantity when diluted with water. Dilution is necessary because a minimal amount of emulsion must be used to avoid imparting excess slip properties to the web/ink surface. The amount of slip imparted to the web is difficult to control even with very low dilution ratios of the silicone lubricant emulsion to water.

The silicone emulsions commonly used as protective lubricants have many advantages and disadvantages. They are less prone to re-solvate the heat-set ink. Further, they impart a very low coefficient of friction (slip) to the printed web. However, such silicone emulsions are disproportionately costly, and frequently impart too much slip (low coefficient of friction) to the printed web. Silicone emulsions are often incompatible with recycled papers and can aggravate paper cracking problems which occur during the binding process. Dilute silicone emulsions do not apply well to the web with currently used application equipment. Silicone oils also inhibit the adhesion of adhesive to the paper, which is commonly applied in bindery and finishing processes. The foregoing disadvantages encountered using known lubricants have driven a search for alternatives.

Alternative formulations have included ingredients like waxes, mixed aromatic and aliphatic hydrocarbon oils, vegetable oils, and cationic surfactants. Such wax, oil, and cationic surfactant-based alternatives may also contain volatile organic compounds. The use of wax, oil and cationic surfactant emulsions alone or as diluents for silicone lubricant emulsions has been largely unsatisfactory. Such unsatisfactory performance may be due to any of the following: build-up of the emulsion on equipment surfaces; insufficient slip; poor application characteristics; ink streaking and marring; loss of gloss; incompatibilities with silicone emulsions; and instability upon dilution. This latter instability is manifest in the rapid physical separation upon dilution of such alternative lubricant emulsions with water. Acceptable processing requires that the lubricant emulsion remain uniformly dispersed and stable in this very dilute solution, as uniform dispersion is essential to uniform application. Even blends of silicone emulsion with wax, oil and/or cationic surfactant emulsions have proven to be unstable on dilution, resulting in marring and streaking problems during the printing process.

One attempt to forego some of these problems involves the use of mixed emulsions, containing one or more polydimethylsiloxanes, mineral oil, a nonionic emulsification agent and water. The mixed emulsions are applied to wet ink just after printing and prior to cure or heat treatment of the printed web. U.S. Pat. No. 5,460,856 discloses this type of mixed silicone oil emulsion. The compositions set forth in this patent, however, require unusual application equipment, as the lubricant emulsion is required to be applied to wet ink prior to curing or heat treatment. Due to the application of the emulsion so early during the process, the viscosity and dilution factors of the emulsion are suited to the processing yet to be undergone, as opposed to that of emulsions intended for application further on in the processing. Therefore, the viscosity and dilution factors of this composition make it unsuitable for application from standard machinery. This method is a significant departure from standard processing and the current state of the art. Further, compositions such as the compositions set forth in the 856 patent require that silicone oil and mineral oil be added slowly to a mixture of water and emulsifier to form the resulting mixed emulsion compositions. Such compositions are less stable upon dilution with water to concentrations used in standard processing. This instability is a result of the method used in the 856 patent to make the mixed silicone oil/mineral oil emulsion.

It is, therefore, one object of the invention to provide a lubricant, applicable to the cured web with standard equipment, which provides enhanced dilute stability, lubrication, anti-static and anti-smudge properties to the cured web.

It is another object of the invention to provide a novel and improved non-silicone oil aqueous emulsion for use as a protective paper lubricant in the applicator equipment of offset lithographic heat-set web presses.

A further object of the invention is to provide a lubricant emulsion that is non-hazardous and contains no volatile organic compounds.

Yet another object of the invention is to provide an economical and universally compatible lubricant emulsion that may be used as a diluent, extender or total replacement for presently used silicone oil emulsions, thereby providing control of the slip or coefficient of friction of the web surface. The disclosed invention is universally compatible with silicone oil emulsions, and therefore can be blended with the same to tailor performance properties, for example, coefficient of friction and economics.

Another object of the invention is to provide a non-silicone lubricant emulsion that is universally compatible with all paper stocks including papers of high recycled content.

Another, and most important, object of the invention is to provide improved application characteristics of aqueous lubricant emulsions, and silicone emulsions modified therewith. The present invention provides a more uniform wet coating across the applicator roller during application of the lubricant emulsion to the paper web.

These and other objects of the invention will become clear to the skilled artisan upon reading and understanding the following disclosure.

SUMMARY OF THE INVENTION

The invention relates to a protective lubricant emulsion for web offset lithographic printing. The emulsion comprises from about 30 wt % to about 70 wt % hydrocarbon oil, from about 1 wt % to about 8 wt % of a surfactant having an HLB factor less than about 6, from about 2 wt % to about 9 wt % of a surfactant having an HLB factor greater than about 11, and from about 25 wt % to 60 wt % water, and has an average particle diameter of from about 500 nm to about 1100 nm. The inventive emulsion enhances control of the dimensional stability of inked sheets and of the coefficient of friction during heatset web printing.

DETAILED DESCRIPTION OF THE INVENTION

The invention relates to a non-silicone oil emulsion of a hydrocarbon oil in water used as a protective lubricant for heat set web printing. The hydrocarbon oil functions as a lubricant, to protect the printed surface. The emulsion is characterized by an average particle diameter of about 500 to 1100 nanometers, with a standard deviation of 200 to 700 nanometers, as measured on a Malvern Laser particle size analyzer, or by a photon correlation particle size analyzer. The particle size distribution is typically a normal distribution as determined by a Chi Square test, known to the skilled artisan.

Proper particle size distribution of the emulsion is important to attaining viscosity characteristics suitable for uniform application of the diluted lubricant emulsion solution, and to retardation of separation of the emulsion upon dilution. Particle size distributions that are too small will result in high viscosities and undesirable application characteristics. Particle sizes that are too large will result in separation upon dilution. Such separation is undesirable because of the resultant uneven distribution of emulsified oils upon application to the web surface. Proper dilute stability and application characteristics of the diluted lubricant emulsions are important to the achievement of uniform distribution of lubricant and moisture across the width of the paper web.

The fast moving paper web is in very brief contact with the applicator roller. As the applicator roller rapidly turns, it carries and applies a thin layer of diluted lubricant emulsion to the paper web. The applicator roller typically shows a smooth and more uniform layer of diluted lubricant emulsion when the compositions of the present invention are used. By contrast, diluted solutions of silicone oil emulsions and alternative lubricants show uneven distribution and voids across the applicator roller. These voids, commonly called "fish eyes", are interruptions in the layer of diluted solution carried by the rapidly rotating applicator roller. Such voids result in uneven application of the diluted solution to the web, with both moisture and lubricant, such as silicone oil, unevenly distributed across the web. Use of the inventive non-silicone aqueous emulsion, however, substantially completely eliminates this processing defect and results instead in a continuous, uniform layer of diluted lubricant emulsion on the applicator roller, which then transfers more uniformly to the heat-set web.

The uniform distribution of moisture resulting from use of the emulsion taught herein is also important to achieving uniform dimensional stability of the paper. The water of the lubricant emulsion is intended to restore the moisture lost during cure to the paper web. If left in the dried, brittle state, the paper will be dimensionally unstable in its final use due to the subsequent non-uniform absorption of humidity (moisture) by the paper, for instance at the edges thereof. Use of the inventive non-silicone oil aqueous emulsion, however, due to its capability for uniform and even application from the applicator roller to the web, ensures uniform remoisturization of the web, thus foregoing problems of dimensional instability.

The compositions of the present invention can be used alone or can be blended with commercially available silicone emulsions. Such modification serves to enhance application characteristics of known silicone emulsions, improves economics and can be used to adjust the amount of slip imparted to the web. Silicone oils impart a very high degree of slip to the paper web, which is frequently undesirable. Lubricant emulsions of the type taught herein impart a much lower degree of slip. Blending the known silicone oils with the inventive non-silicone oil aqueous emulsion allows for tailoring a given lubricant solution to the particular needs of the printer. In many applications, the amount of slip imparted to the web by compositions in accord with the present invention alone is sufficient. Ranges of blends of silicone oil emulsions and compositions of the invention are 10% to 80% silicone oil emulsions to 90% to 20% lubricant emulsions of the invention.

An advantage of the use of compositions of this invention is that such blends are compatible and do not separate after storage or dilution with water. Dilutions of such blends with 90% to 99% water are stable for prolonged periods, offering a further advantage during application to the web.

The compositions of the invention generally comprise a predominantly aliphatic hydrocarbon oil component in combination with water and an emulsifying surfactant component. Additionally, an anti-static agent, an anti-foam agent, and a biocide may be incorporated into the lubricating emulsion. Suitable hydrocarbon oils used in compositions of the present invention are those hydrocarbons characterized by a low aromatic carbon content of 5% (wt.) or less. Higher aromatic carbon content oils are stronger solvents for heat set inks. Solvation of the heat-set inks by the higher aromatic hydrocarbons may cause subsequent streaking or marring.

Preferred hydrocarbon oils are typically comprised of 50% to 100% (wt %) paraffinic or isoparaffinic hydrocarbon oils, 0% to 50% naphthenic hydrocarbon oils, and 0% to 2% aromatic hydrocarbon oils. Such oils are typically refined and are of minimal color, or colorless, with Saybolt color index values (ASTM D156) of 28 or higher. The oils have a kinematic viscosity of 30 to 150 centistokes (cst) or higher at 40° F. Molecular weight ranges of such oils are typically 250 to 700 or more. Such oils are commercially available as "white oils" or "white mineral oils".

The concentration of the preferred hydrocarbon oil in the lubricant emulsions is about 30% to about 70% (wt). Preferably, the concentration of hydrocarbon oil is about 50% to about 60% (wt).

The surfactants preferred as emulsifiers for the hydrocarbon oil component herein are typically non-ionic surfactants. Select anionic surfactants may also be useful when judiciously chosen to minimize foam. A combination of two or more surfactants of differing hydrophilic/lipophilic (HLB) balance is preferred to attain optimum dilute stability and necessary particle size distribution. Non-ionic surfactants that may be used include, but are not limited to, ethoxylated alkyl phenols, ethoxylated alcohols, ethoxylated fatty acids, block copolymers of ethylene oxide and propylene oxide, acetylenic glycol ethoxylates, ethoxylated sorbitan derivatives and sorbitan derivatives. The preferred surfactants will also promote compatibility with commercially available silicone emulsions.

Optimum dilute stability is achieved with a properly selected blend of emulsifying surfactants. Preferred surfactant blends of this inventive emulsion include a nonionic surfactant of HLB 2 to 6, such as octoxynol-3, and a second nonionic surfactant of HLB 11 to 16, such as nonoxynol-9. The higher HLB surfactant is generally used in higher concentration to achieve proper stability upon water dilution. Such surfactant systems have the added advantage of promoting compatibility with commercially available silicone oil emulsions at any blend ratio of the non-silicone oil aqueous hydrocarbon emulsion to the silicone oil emulsion. In using a combination of surfactants, an average HLB factor of 12.0 to 13.0 is preferable. Dow Corning PS series silicone oil emulsions and General Electric SM series silicone oil emulsions are examples of commercially available silicone oil emulsions that may be blended with the non-silicone oil aqueous emulsion of the invention when the preferred emulsifying surfactants are used.

Other optional ingredients of the non-silicone aqueous emulsion may include: an anti-static agent at up to 4%, with 0.3% to 2% being the preferred amount; an anti-foam agent at up to 1%, with 0.2% to 0.5% being the preferred amount; and a biocide at up to 1.5%, with 0.8% to 1.2% being the preferred amount. The anti-static agent aids in finishing where the web is cut into sheets. The anti-foam agent aids in processing the emulsion. The biocide retards microbial growth. Table I below sets forth compositional ranges for the various components of the inventive emulsion.

TABLE I

Non-silicone Oil Aqueous Emulsion Composition

| | Composition Ranges (wt %) | Preferred Ranges (wt %) |
|---|---|---|
| oil, paraffinic | 30–70 | 50–60 |
| lo HLB surfactant | 1–8 | 2–4 |
| hi HLB surfactant | 2–9 | 4–6 |
| anti-static | 0–4.0 | 0.3–2.0 |
| anti-foam | 0–1.0 | 0.2–0.5 |
| water | 25–60 | 25–38 |
| biocide | 0–1.5 | 0.8–1.2 |

The following Examples are provided to more thoroughly exhibit the manner in which lubricant emulsions according to this invention can be prepared and employed to enhance printing and print quality. They are not intended to be limitative of the invention in any manner, but serve merely as a means of illustration to aid the skilled artisan in using the technology taught herein.

In each of the examples which follow, the lubricant emulsion was prepared using a high speed disk disperser of the type made by Morehouse-Cowles, Inc. Or Hockmeyer, Inc. The final product can be homogenized in a rotor-stator type homogenizer. In preparing the emulsion, the entire amount of oil was charged to an appropriate size vessel, under the high speed disperser. The mixer was started at 100 to 400 rpm. The surfactants, antistatic agent, antifoam agent, and biocide were then charged to the oil under agitation and mixed for 10 to 30 minutes. Subsequent to this mixing period, water was added at the rate of from 3 to 10 gallons per minute and the mixer speed was increased to 800 to 1200 rpm as the mixture thickened during the addition of the water. Once the entire portion of water was added, the mixture was left to mix for about 10 to 30 minutes longer. The emulsion was then completed by homogenization through a rotor-stator type homogenizer at 10 to 40 gallons per minute.

Examples 1 through 3 are representative emulsions in accord with the invention as prepared by the foregoing method.

EXAMPLE 1

| Component | Wt % of Lubricant Emulsion |
|---|---|
| White oil, Hydrobrite 550 PO (Witco) | 60.0 |
| Octoxynol-3, Triton X-35 (Union Carbide) | 3.4 |
| Octoxynol-13, Triton X-102 (Union Carbide) | 5.6 |
| Alkylquaternary ammonium salt Monstat 1195 (Mona Industries) | 0.3 |

-continued

| Component | Wt % of Lubricant Emulsion |
|---|---|
| Antifoam 1430 (Dow Corning) | 0.3 |
| Biocide Kathon (Rohm & Haas) | 1.0 |
| Water | 29.4 |
| Total | 100.0 |

EXAMPLE 2

| Component | Wt % of Lubricant Emulsion |
|---|---|
| White oil, Shellflex 371 (Shell) | 27.5 |
| White oil, Britol 50T (Witco) | 27.5 |
| Octoxynol-9, Triton X-100 (Union Carbide) | 2.8 |
| Nonoxynol-9, Igepal CO-630 (Rhone Poulenc) | 3.0 |
| Octoxynol-5, Triton X-45 (Union Carbide) | 3.2 |
| Biocide, BNPD-95 (Angus) | 0.1 |
| Antifoam, Sag-10 (Union Carbide) | 0.2 |
| Water | 35.7 |
| Total | 100.0 |

EXAMPLE 3

| Component | Wt % of Lubricant Emulsion |
|---|---|
| White oil, Duoprime 300 (Lyondell) | 50.0 |
| Nonoxynol-9, Igepal CO630 (Rhone Poulenc) | 8.0 |
| Sodium 2-ethylhexyl sulfate (Witco) | 0.5 |
| Sorbitan Monooleate (PPG Mazer) | 2.0 |
| Antifoam 1430 (Dow Corning) | 0.3 |
| Water | 39.2 |
| Total | 100.0 |

The emulsions of Examples 1, 2 and 3 can be further blended with commercially available silicone oil emulsions, such as Dow Corning PS63 or General Electric SM2163. The ratio of blends of this type is dependent on the type of printing for which the emulsion is intended and other relevant considerations, all well known to the skilled graphics arts chemist. Emulsions which comprise such a blend of the inventive emulsion in accord with the invention and a commercially available emulsion are shown below in Examples 4 and 5.

EXAMPLE 4

| Component | Wt % of Total Emulsion |
|---|---|
| Lubricant Emulsion of Ex. 1 | 70.0 |
| Dow Corning PS63 | 30.0 |
| Total | 100.0 |

EXAMPLE 5

| Component | Wt % of Total Emulsion |
|---|---|
| Lubricant Emulsion of Ex. 1 | 50.0 |
| GE SM2163 | 50.0 |
| Total | 100.0 |

The emulsions of Examples 1 through 3 or the blends of Examples 4 and 5 are intended to be diluted with water prior to use on the heatset web press. Typical dilution ratios are 96 parts water 4 parts lubricant emulsion, all by volume, the emulsion being that of any one of Examples 1–5 or any other in accord with the invention. The concentration of white oil in diluted press-ready solution is typically, therefore, about 1.0 to 2.5% by volume of the total dilution.

The inventive emulsion may alternatively be prepared in a partially prediluted solution. This is accomplished by adding water to emulsions prepared in accord with the foregoing Examples 1–5. In such a prediluted solution, less water must be added immediately prior to use in order to achieve the necessary press-ready concentration. Typical prediluted solutions will have component concentrations as indicated in Table II below.

TABLE II

Prediluted Non-silicone Oil Aqueous Emulsion Composition

| | Composition Ranges (wt %) | Preferred Ranges (wt %) |
|---|---|---|
| oil, paraffinic | 10–30 | 20–30 |
| lo HLB surfactant | 0.5–3.0 | 1–2 |
| hi HLB surfactant | 1.0–6.0 | 1.5–3.0 |
| anti-static | 0–3.0 | 0.1–1.5 |
| anti-foam | 0–0.7 | 0.1–0.3 |
| water | 55–89 | 65–75 |
| biocide | 0–1.0 | 0.1–0.5 |

An important characteristic of a lubricating emulsion is that it allows the cured ink to remain intact on the printed sheet or substrate, and does not resolvate or soften the cured heatset ink. This aspect or characteristic was tested and a comparison made between emulsions developed in accord with the invention herein and a typical commercially available emulsion. The test was performed on sheets printed with a solid magenta ink film. Rating was done on a scale of 1 to 5, wherein 1 was the lowest rating and corresponded to total ink removal and 5 was the highest rating and was indicative of no ink removal. The test involved placing drops of undiluted lubricant emulsion on the inked sheets, which were laid horizontally or flat, and allowed to stand for 10 minutes. The sheets were then placed vertical to allow for drainage. Ink attack was then observed and rated. The results are shown below in Table III.

TABLE III

| INK SOLVATION | |
|---|---|
| EMULSION | SOLVATION RATING |
| Undiluted commercial silicone emulsion | 2 |
| Emulsion of Example 1 | 4 |
| Emulsion of Example 5 | 3 |

As is seen in Table III, the emulsion according to the invention performed better with respect to not resolvating the heatset ink than the known emulsion. It is also noted that in the testing performed above the emulsion according to the invention used alone outperformed the combination of the inventive emulsion and a typical commercial emulsion.

Further testing was performed to determine the static coefficient of friction on the paper surface. This parameter is evaluated by making slide angle measurements. Tests and apparatus used in the industry to make these measurements are described in Technical Association of Pulp and Paper Making Industry (TAPPI) Test Method T548. The method was modified for use herein by using lab prepared paper sheets upon which a thin film of heatset ink was applied and then cured. The diluted lubricant emulsions (4% lubricant emulsion to 96% water by weight) were then applied to the inked sheets. The results demonstrate the ability to adjust the coefficient of friction of the blended emulsions, and are reported in Table IV below.

TABLE IV

| SLIDE ANGLE IN DEGREES | | | |
|---|---|---|---|
| | DILUTED COMMERCIAL SILICONE EMULSION | DILUTED EXAMPLE 1 | DILUTED EXAMPLE 5 |
| REPLICATE 1 | 19.0 | 24.5 | 21.5 |
| REPLICATE 2 | 19.5 | 23.0 | 22.0 |

The data shows the angle to which a hinged, horizontal platform is raised in order to move a flat slide across a paper sheet fastened to the horizontal platform. The lower angle represents a lower static coefficient of friction and therefore, less resistance of the paper surface to movement of the slide. The higher angle represents greater resistance.

Improved application characteristics of the diluted lubricant emulsions have been repeatedly observed in tests on heatset web presses. Application characteristics from a press run on a Harris M1000 heatset web press were rated on a scale of 1 to 10, 1 being the worst and indicating the presence of fish eyes and poor wet film uniformity over at least 50% of the roller surface, and 10 being the best and indicating the complete absence of fish eyes and perfect uniformity of wet film on the applicator roller. A rating of 5 is defined as adequate, having moderate film uniformity and 10 or more fish eyes. During this trial, various diluted lubricant emulsions were observed, in random order. Observations were made regarding the uniformity of the wet film and the occurrence of fish eyes on the applicator roller. Results of this testing are presented in Table V.

TABLE V

| EMULSION UNIFORMITY | |
|---|---|
| EMULSION | RATING |
| Diluted commercial silicone emulsion | 3 |
| Diluted Example 1 Emulsion | 8 |
| Diluted Example 5 Emulsion | 6 |

It is clear from the data presented above in Tables III through V that the emulsion which consistently performed the best was the emulsion prepared in accord with the invention, while that emulsion when combined with a known emulsion performed slightly lower given the ratings applied. In each instance the known commercial emulsion performed in a substandard manner.

The use of a non-silicone oil aqueous lubricating emulsion in accord with the invention enhances many parameters of the printing process in heatset web printing. It is applied easily from standard equipment and imparts enhanced lubricity, anti-static and anti-smudge properties to the printed page or substrate. Further, there is minimal problem with resolvation of the cured ink. Therefore, the emulsion of the invention protects the printed sheet by providing a uniform wet coating across the applicator roller during application of the lubricant emulsion to the paper web. The universal compatibility of this inventive emulsion with all paper stocks and the dimensional stability imparted by the inventive emulsion to the printed sheets make the non-silicone aqueous emulsion a desirable and viable option for heatset web printing.

We claim:

1. A protective non-silicone oil aqueous lubricant emulsion for web off-set lithographic printing, comprising:

from about 30 wt % to about 70 wt % hydrocarbon oil;

from about 1 wt % to about 8 wt % of a low HLB surfactant having an HLB factor less than about 6;

from about 2 wt % to about 9 wt % of a high HLB surfactant having an HLB factor greater than about 11; and from about 25 wt % to 60 wt % water, the emulsion having an average particle diameter of from about 500 nm to about 1100 nm.

2. The emulsion of claim 1 wherein the hydrocarbon oil comprises a white oil containing about 50 wt % to 100 wt % paraffinic or isoparaffinic hydrocarbon oil, 0 wt % to about 50 wt % naphthenic hydrocarbon oil, and 0 wt % to about 5 wt % aromatic hydrocarbon oil, and exhibiting a kinematic viscosity of at least 30 to 150 cst at 40° F.

3. The emulsion of claim 1 wherein the surfactant is a non-ionic surfactant selected from the group consisting of ethoxylated alkyl phenols, ethoxylated alcohols, ethoxylated fatty acids, block copolymers of ethylene oxide and propylene oxide, acetylenic glycol ethoxylates, ethoxylated sorbitan derivatives, sorbitan derivatives, and combinations thereof.

4. The emulsion of claim 3 wherein the surfactant is a blend of at least two non-ionic surfactants comprising a non-ionic surfactant having an HLB factor between 2 and 6 and a non-ionic surfactant having an HLB factor between 11 and 16.

5. The emulsion of claim 1 wherein the emulsion further comprises at least one of an anti-static agent, an anti-foam agent and a biocide agent.

6. The emulsion of claim 5 comprising:

a) about 60 wt % white hydrocarbon oil;

b) about 3.4 wt % low HLB surfactant;

c) about 5.6 wt %,high HLB surfactant;

d) about 0.3 wt % anti-static agent;

e) about 0.3 wt % anti-foam agent;

f) about 1.0 wt % biocide agent; and g) about 29.4 wt % water.

7. The emulsion of claim 1 in further combination with a commercial heatset web lubricant silicone emulsion.

8. A process for restoring dimensional stability to a cured heat-set printed web comprising applying a dilute non-silicone oil aqueous emulsion uniformly to the cured heat-set printed web from an applicator roller, the non-silicone oil aqueous emulsion exhibiting an average particle diameter of from about 500 to about 1100 nm and comprising a light hydrocarbon oil component, a surfactant component, and water.

9. The process of claim 8 wherein the dilute non-silicone oil aqueous emulsion comprises the emulsion, comprising from about 30 wt % to about 70 wt % hydrocarbon oil; from about 1 wt % to about 8 wt % of a low HLB surfactant having an HLB factor less than about 6; from about 2 wt % to about 9 wt % of a high HLB surfactant having an HLB factor greater than about 11; and from about 25 wt % to 60 wt % water, the emulsion having an average particle diameter of from about 500 nm to 10 about 1100 nm, diluted to a concentration of up to about 10% by volume with water.

10. The process of claim 9 wherein the dilute emulsion exhibits a white oil concentration of less than about 6% by volume.

11. The process of claim 9 wherein the dilute emulsion exhibits a white oil concentration of about 2.0 to 2.5% by volume.

12. The process of claim 9 wherein the non-silicone aqueous emulsion comprises:

about 60 wt % white hydrocarbon oil;

about 3.4 wt % low HLB surfactant;

about 5.6 wt % high HLB surfactant;

about 0.3 wt % anti-static agent;

about 0.3 wt % anti-foam agent;

about 1.0 wt % biocide agent; and about 29.4 wt % water prior to dilution.

13. The process of claim 8 wherein the dilute emulsion exhibits substantially no voids on the applicator roller upon application to the printed paper web.

14. A process for controlling the coefficient of friction of a paper web surface in heatset web printing processes comprising applying a dilute non-silicone aqueous emulsion to an inked web subsequent to curing of the inked web to at least about 80% dry, the dilute emulsion comprising: from about 30 wt % to about 70 wt % hydrocarbon oil; from about 1 wt % to about 8 wt % of a low HLB surfactant having an HLB factor less than about 6; from about 2 wt % to about 9 wt % of a high HLB surfactant having an HLB factor greater than about 11; and from about 25 wt % to 60 wt % water, the emulsion having an average particle diameter of from about 500 nm to about 1100 nm, diluted to a concentration of not more than 10% by volume in water.

15. The process of claim 14 wherein the non-silicone aqueous emulsion, prior to dilution, comprises : about 60 wt % white hydrocarbon oil; about 3.4 wt % low HLB surfactant; about 5.6 wt % high HLB surfactant; about 0.3 wt % anti-static agent; about 0.3 wt % anti-foam agent; about 1.0 wt % biocide agent; and about 29.4 wt % water.

16. The process of claim 15 wherein the non-silicone aqueous emulsion is blended with a commercial silicone emulsion.

17. The process of claim 14 wherein the non-silicone aqueous emulsion is diluted to a concentration of not greater than about 10% by volume in water.

18. The process of claim 14 wherein the hydrocarbon oil concentration in the dilute emulsion is about 2.0 to 2.5% by volume.

19. A prediluted protective non-silicone oil aqueous lubricant emulsion for web off-set lithographic printing, comprising:

from about 20 wt % to about 30 wt % hydrocarbon oil;

from about 1 to about 2 wt % of a low HLB surfactant having an HLB factor less than about 6;

from about 1.5 to 3 wt % to about 6 wt % of a high HLB surfactant having an HLB factor greater than about 11; and from about 65 wt % to 75 wt % water, the emulsion having an average particle diameter of from about 500 nm to about 1100 nm.

20. The prediluted emulsion of claim 19 wherein the hydrocarbon oil comprises a white oil containing about 50 wt % to 100 wt % paraffinic or isoparaffinic hydrocarbon oil, 0 wt % to about 50 wt % naphthenic hydrocarbon oil, and 0 wt % to about 5 wt % aromatic hydrocarbon oil, and exhibiting a kinematic viscosity of at least 30 to 150 cst at 40° F.

21. The prediluted emulsion of claim 19 wherein the surfactant is a non-ionic surfactant selected from the group consisting of ethoxylated alkyl phenols, ethoxylated alcohols, ethoxylated fatty acids, block copolymers of ethylene oxide and propylene oxide, acetylenic glycol ethoxylates, ethoxylated sorbitan derivatives, sorbitan derivatives, and combinations thereof.

22. The prediluted emulsion of claim 21 wherein the surfactant is a blend of at least two non-ionic surfactants comprising a non-ionic surfactant having an HLB factor between 2 and 6 and a non-ionic surfactant having an HLB factor between 11 and 16.

23. The prediluted emulsion of claim 19 wherein the emulsion further comprises at least one of an anti-static agent, an anti-foam agent and a biocide agent.

24. The prediluted emulsion of claim 23 comprising:

a) about 20 to 30 wt % white hydrocarbon oil;

b) about 1 to 2 wt % low HLB surfactant;

c) about 1.5 to 3.0 wt % high HLB surfactant;

d) about 0.1 to 1.5 wt % anti-static agent;

e) about 0.1 to 0.3 wt % anti-foam agent;

f) about 0 to 0.1 wt % biocide agent; and g) about 65 to 75 wt % water.

25. The prediluted emulsion of claim 19 in further combination with a commercial heatset web lubricant silicone emulsion.

* * * * *